US005561924A

United States Patent [19]

Ramey

[11] Patent Number: 5,561,924

[45] Date of Patent: Oct. 8, 1996

[54] APPARATUS FOR ADJUSTING THE ATTITUDE OF CONSTRUCTION EQUIPMENT

[76] Inventor: Thomas N. Ramey, 1529 Bernina Dr., Frazier Park, Calif. 93222

[21] Appl. No.: 230,486

[22] Filed: Apr. 20, 1994

[51] Int. Cl.[6] ..... E02F 3/76

[52] U.S. Cl. ..... 37/415; 172/4.5; 280/6.12; 280/6.11

[58] Field of Search ..... 37/414, 415; 172/239, 172/400, 407, 421, 798, 4.5; 280/6.11, 6.12, 890, DIG. 1, 704

[56] References Cited

U.S. PATENT DOCUMENTS

| | | | |
|---|---|---|---|
| 2,790,648 | 4/1957 | Sweetland | 280/840 |
| 3,561,538 | 2/1971 | Curlett et al. | 172/798 X |
| 3,695,713 | 10/1972 | Rothi et al. . | |
| 3,976,302 | 8/1976 | Hammarstrand | 280/6.12 |
| 4,067,395 | 1/1978 | Verhoff . | |
| 4,090,723 | 5/1978 | Hart | 280/6.12 |
| 4,207,692 | 6/1980 | Hyler et al. | 37/414 |
| 4,449,733 | 5/1984 | Iida et al. | 37/415 X |
| 5,037,160 | 8/1991 | Ukai . | |
| 5,180,028 | 1/1993 | Perrenoud, Jr. | 280/6.12 X |

FOREIGN PATENT DOCUMENTS

| | | | |
|---|---|---|---|
| 649679 | 10/1962 | Canada | 280/6.11 |
| 1918393 | 2/1971 | Germany | 280/6.12 |
| 749699 | 7/1980 | U.S.S.R. | 280/6.12 |
| 1486365 | 6/1989 | U.S.S.R. | 280/6.11 |
| 1586922 | 8/1990 | U.S.S.R. | 280/6.11 |

*Primary Examiner*—Ramon S. Britts
*Assistant Examiner*—Frederick L. Lagman

[57] ABSTRACT

In a scraper, or the like, having as its purpose the cutting of a level swath in an earthen terrain, and receiving the earth cut from the terrain, in which the cutting blade is mounted, in a level attitude, to a scraper frame, which frame is itself mounted on wheels for movement along the terrain, means for adjusting the wheels relative to the frame so as to maintain the level attitude of the blade over uneven terrain, or under conditions of uneven loading of the earth removed from the swath.

5 Claims, 2 Drawing Sheets

APPARATUS FOR ADJUSTING THE ATTITUDE OF CONSTRUCTION EQUIPMENT

The present invention relates generally to heavy equipment for constructing roadways and the like, and has particular, although not exclusive, utility in permitting the operator of such equipment to adjust the attitude, or position, of all, or a portion of, such equipment transverse to the line of travel.

BACKGROUND OF THE INVENTION

1. Field of the Invention

The innovation described herein was the result of a study of several interrelated problems inherent in the construction of road beds, and other similar leveling tasks which are faced on a daily basis by those who do such work.

More particularly, it has been observed that elevating scrapers, such as a Caterpillar® 623E, or the John Deere® 862B, identified by way of example of the type of equipment only, tend to load unevenly. As a consequence, the scraper tends to list to the heavy side, and when it does, the scraper blade will tend to dig in on that side, resulting in an uneven cut. Since the function of the scraper is to provide a level cut, the purpose of using such a piece of equipment is severely compromised.

In yet another circumstance, the elevating scraper may encounter topographical changes along the same path. As a result, the left or right set of wheels may be elevated from time to time, which will, of course, adversely effect the orientation of the blade and the resultant cut which the blade can deliver.

2. Overview of the Prior Art

The problems articulated above, and others of a similar ilk, are not uncommon in the use of elevated scrapers and other off road, heavy construction equipment.

To date, the generally accepted solution has been to alter the attitude of the blade itself by use of mechanical or hydraulic means, or a combination of both, and the familiar motor graders are typical of such devices. See also, Ukai Patent 5,037,160, and Rothi et al. Patent 3,695,713.

It will be appreciated, however, that when the blade is attached to bowls having a capacity in the 10 to 15 yard range, adjustment of the blade in any significant amount is not only inefficient, it is extremely difficult and, where possible, highly complicated. Even in today's multi-million dollar construction projects, the ability to perform in a cost effective manner is extremely important, and without the ability to make necessary adjustments from the cab in such equipment, cost effective performance is simply out of the question.

Verhoff Patent 4,067,395, is of general interest only, in that it relates to land leveling equipment in a broad sense. The Verhoff type system is designed primarily for use, in agricultural settings, wherein large fields are to be leveled and graded to provide for, inter alia, tail water run off, as part of the irrigation scheme.

Machinery such as that disclosed in Verhoff, was in extensive use in the late 70's and employed a "gauge frame" to serve as a reference for the adjustment of the main frame to level out high and low spots in the line of travel.

Verhoff type levels have become more sophisticated and are currently in use with laser devices which focus a laser beam at the sensing system 75 to establish a desired height of the machine and, thus, the level at which the land traversed by the machine will be cut.

Verhoff never intended his device to be adjustable in a direction transverse to the forward movement of the blade, and it is incapable of such adjustment.

Verhoff does use a hydraulic motor, and what appears to be an over center linkage, to simultaneously adjust the height of a pair of supporting wheels for the purpose of establishing the depth of the cut to be taken by the device as it is pulled along by the tractor.

Verhoff does not, and can not, as does Applicant, provide transverse adjustment of the attitude of the machine to compensate for uneven loading, nor does it compensate for uneven terrain transverse to the line of travel.

SUMMARY OF THE INVENTION

The apparatus of the present invention achieves a primary objective by offering, to the heavy equipment operator, an efficient solution to the problems of uneven loading of the bowl of an elevating scraper, for example, as well as that of uneven terrain transverse to its line of travel, and places that solution at the operator's fingertips in order that the operator may readily, and immediately, correct for conditions encountered in the field.

More particularly, the present invention provides the operator of an elevating scraper, for example, with the ability to adjust the height of its driven wheels relative to the frame, transverse to the direction of travel, to thereby maintain the level attitude of the frame, and the blade affixed thereto, to compensate for uneven loading and terrain, while providing a level cut.

In its simplified form, the present invention permits an operator of a scraper, or the like, to cut a level swath through native soils, notwithstanding the terrain, to either side of the cut, or the imbalance caused by uneven loading.

The foregoing, as well as other purposes and objectives, will become evident from a reading of the detailed specification, herein provided, in conjunction with the drawings, wherein:

Having thus illustrated the present invention, with variations of a preferred embodiment, the following detailed description, read in the context of the various drawings, will explain, and make clear, the essence and value of the invention.

DETAILED DESCRIPTION OF A PREFERRED EMBODIMENT

Figure 1:
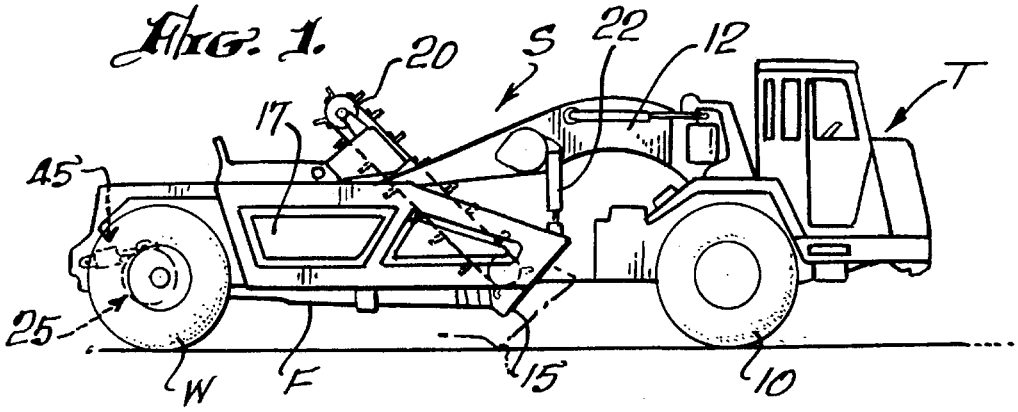
FIG. 1 is a side elevation, pictorially displayed, of an elevating scraper of the type to which the present invention has particular, thought not exclusive, utility.

With reference now to the drawings, and initially to FIG. 1, a familiar piece of off road construction equipment, namely an elevating scraper, illustrated at S, comprising an articulated frame F, is secured to a tractor T. The tractor T is supported on driven wheels W, with the rear portion of the frame supported on drive wheels 10. The forward end of the frame F, is connected to the tractor by a goose neck 12, which is free to pivot, or articulate, about its attachment point, the specific details of which are not specifically illustrated, but are well known in the industry.

The elevating scraper S includes a straight blade 15, which is mounted forward of a bowl 17, and transverse to the direction of scraper travel. The bowl 17 receives, and holds for transportation, earth and other material that is cut by the blade as the scraper moves forward. In the illustrated scraper, an elevator 20 picks up and transports cuttings from the upper surface of the blade 15, to the bowl 17.

As may be seen in FIG. 1, the blade is raised and lowered by means of hydraulic rams 22, which are controlled in the cockpit of the tractor T. The blade is intended to be secured in a position which is not only transverse to the direction of travel of the scraper, but in a horizontal position relative to the ground when the scraper is at rest on a perfectly level site.

As previously stated, however, a scraper of the type referenced here seldom has the luxury of traversing level terrain. Moreover, even where the terrain is relatively level, the function of the scraper is to cut a level swath as it moves forward. To the extent that the terrain being traversed by the blade is not level transverse to the line of travel, the blade will cut a non-level swath, removing more material in the lower areas than in those which are higher.

As a consequence, the quantity of material being deposited in the bowl will be more in the area within the bowl which is in the same vertical plane as the higher areas of soil. The result is to load the bowl unevenly, which will, in turn, place more weight on one of the drive wheels W than the other, and considering that the material removed may well have a density of more than 1,300 pounds per cubic yard, the scraper will inevitably list to the heavy side of the bowl. The cut thus taken by the blade will be at an angle, as distinguished from level, and additional grading machinery will be called upon to correct the situation, at significant additional expense.

The apparatus of the present invention addresses this problem in a unique fashion, by maintaining the level attitude of the frame F relative to the drive wheels 10, to compensate for uneven loading in the bowl, or uneven terrain traversed by the individual wheels, or both. Thus, a level swath may be achieved, which will minimize, if not eliminate, remedial work by a motor grader.

The maintenance of the level attitude of the frame F as it moves forward is accomplished, in accordance with the invention, by adjusting the position of the drive wheels W relative to the position of the frame F, upon which each wheel W is supported, and rides.

Figure 2:
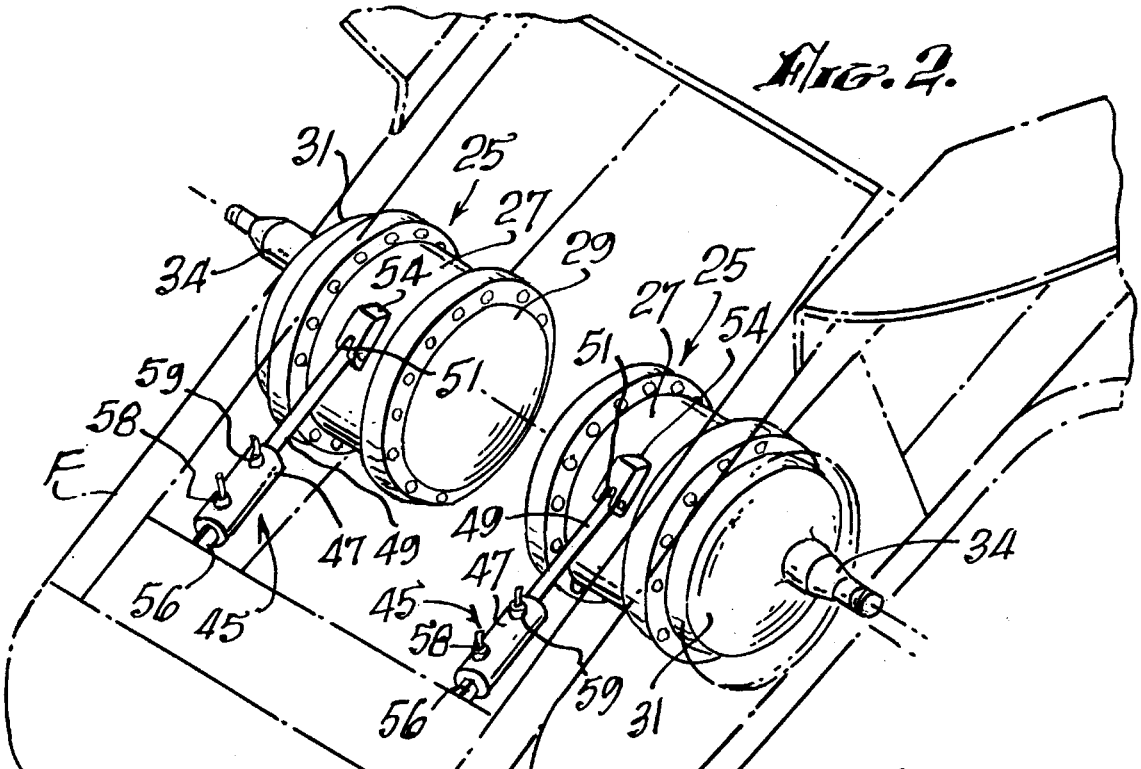
FIG. 2 is a perspective view of a portion of the undercarriage of the scraper of FIG. 1, illustrating one form of the attitude adjustment means of the present invention.
Figure 3:
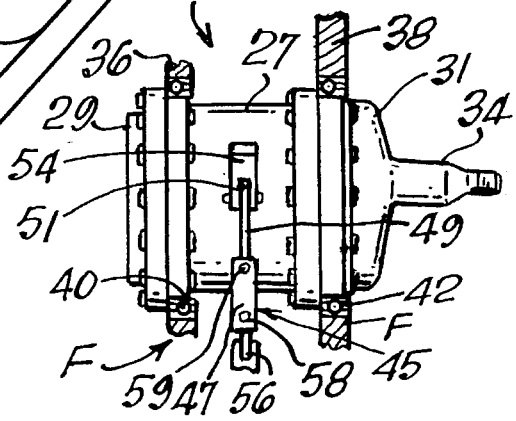
FIG. 3 is a top view, partially sectioned, of the axle and hub of a scraper such as that illustrated in FIG. 1, showing a portion of the mechanism for rotating the hub to adjust the height of the frame of the scraper relative to the wheel.

In achieving this objective a scraper is positioned with driven wheels rotatably mounted on axle assemblies to the frame F, which include hubs 25, as best seen in FIGS. 2 and 3. Each hub 25, which in this configuration also serves as an axle, is independently mounted, for limited relative movement to the frame of the scraper, comprises, as seen in FIG. 3, a cylindrical member 27, having an internal, or inwardly facing end cap 29, and an outwardly facing, or exterior, end cap 31.

The cap 31 has a spindle 34 extending outwardly therefrom, beyond the perimeter of the frame, for receiving a wheel 10, which is rotatably secured on the spindle 34 in any well known manner. In keeping with this aspect of the invention, it will be noted that the spindle 34 is eccentric with the hub 25, being offset from the longitudinal centerline of the hub by a predetermined amount, the specific dimension of which is a matter of informed choice governed by the amount of adjustment needed to accomplish the purposes of the invention.

Each hub 25 is secured relative to the frame F, on axles, which in this embodiment are in the form of rings, or flanges. Thus, each hub is positioned relative to the frame, internally by axle flange 36, and externally by axle flange 38.

The specific means of securing each hub 25 is not significant to the invention except to point out that the cylindrical member 27 must be mounted for rotation relative to the frame on an axis concentric with the axis of its axle. One way of accomplishing this necessary feature is to secure each flange 36 and 38 to the outer race of internal and external bearing housings, 40 and 42, respectively. By spacing the bearing housings 40 and 42 as shown, more uniform loading is achieved and by connecting the cylindrical member to the internal race of the bearing within the bearing housings, it becomes free to rotate.

By rotating the cylindrical housing 27, the spindle is rotated, and due to the eccentricity of the spindle, the relative position of the frame relative to the wheel mounted on the spindle is adjusted, and, consequently, the attitude of the frame itself, relative to the ground, is likewise adjusted.

Figure 4:
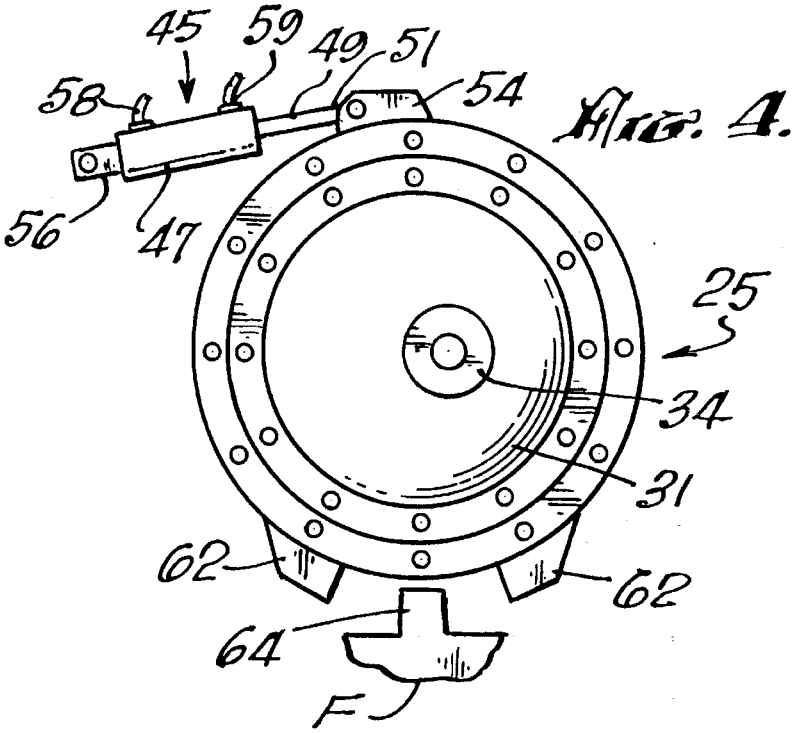
FIG. 4 is a side elevation of the hub and axle of the present invention as illustrated on FIG. 3.
Figure 5:
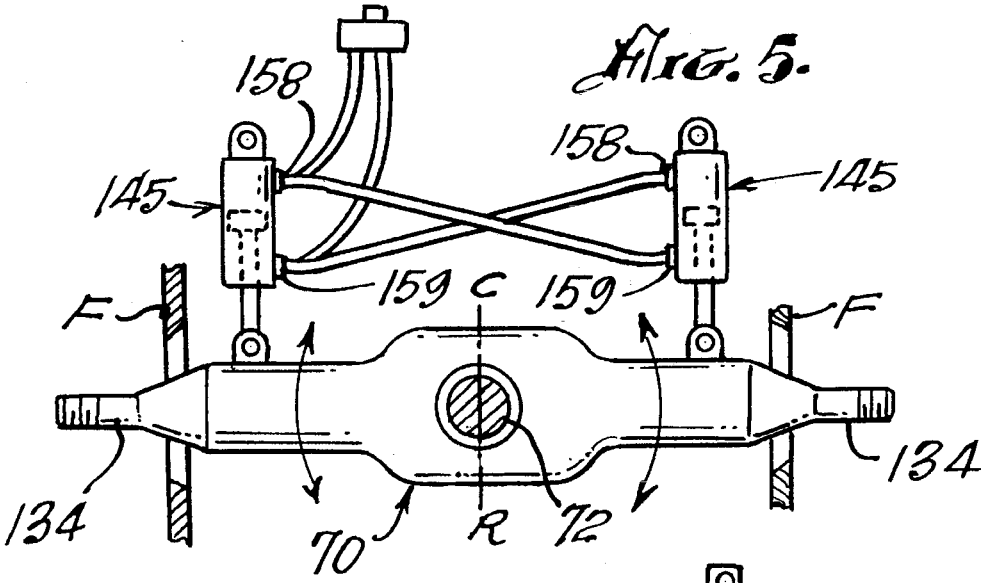
FIG. 5, is a side elevation of a modified form of an attitude adjustment device which works directly on a center pivoted, solid axle-type configuration, as distinguished from the independent wheel hubs of FIGS. 2, 3 and 4; and, FIG. 6 is a view similar to that of FIG. 5, wherein a solid axle configuration is shown with an offset pivot point, and a single actuator to adjust the position thereof.

In order for the apparatus of the present invention to achieve its full potential attitude adjustment and, coincidentally, movement of the cylindrical hub must be controlled. Moreover, the element of control must be in the hands of the operator. This is accomplished, in accordance with the invention, by the use of hydraulic motors 45. Referring to FIGS. 4 and 5, the motor 45 comprises a cylinder 47, from which an extensible ram 49 protrudes. The free end 51 of the ram 49 connects to a pillow block 54, by means of a bearing, not specifically shown. The free end 56 of the cylinder 47 is anchored to the frame, likewise in a bearing, not shown.

The cylinder 47 is coupled to the hydraulic system of the scraper, and is provided with fluid ports 58 and 59, respectively. Movement of the cylinder 27 is readily accomplished by simply applying fluid pressure through one of the ports 58 or 59, to one side or the other of the piston disposed within the cylinder 47, while coincidentally relieving the pressure through the other port.

It has been found to be desirable to limit the arc through which the hub can rotate. However, to limit that movement by means of the hydraulic motor 45, would require the motor to be much stronger than would be practical under the circumstances. In order to limit, therefore, the range of movement of the hub, mechanical stops, or ears, 62 are affixed, such as by welding to an area of the cylinder 27, on opposite sides, and in the same plane of a tang 64, secured to the frame F. In observing this arrangement in FIG. 5, it will be apparent that a very inexpensive, yet effective, limitation has been placed on the arc through which the hub may be rotated.

By controlling both hubs independently, one spindle can be raised while the other is lowered, which provides a maximum change in attitude, and, of course, an infinite number of intermediate adjustments is possible. Because this novel system is interconnected with the hydraulic system of the scraper, suitable controls, of any of several well known configurations and, therefore, not specifically illustrated, can be readily placed in the cockpit at the hands of the operator and may even be integrated with other existing controls for ease of operation.

Figure 6:
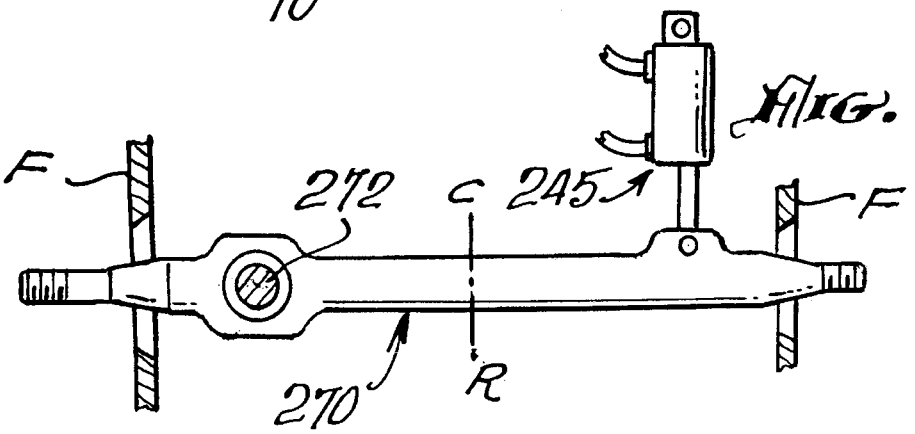

With reference now to FIGS. 5 and 6, the principals which prescribed the success of the present invention are capable of being applied to scrapers, or the like, which employ a transverse single, solid axle, as distinguished from the independent hubs which have been the subject of the first part of this description.

In FIG. 5, a solid axle 70 is depicted, which is rotatably mounted on a horizontal axis about a centrally disposed pin, or post, 72. A pair of hydraulic motors interconnect the left and right sides, respectively, of the axle 70. By plumbing the motors 145 such that port 158 of one of the motors interconnects with port 159 of the other, the pistons will move in opposite directions, thereby raising one spindle while lowering the other. As a result, the frame, and thus the blade of the scraper, is tilted to acclimate the scraper to both terrain and load conditions.

With reference now to FIG. 6, it will be seen that the solid axis configuration can be made to accomplish the objectives of one hydraulic motor.

Such a configuration is appropriate in lighter equipment, where the amount of force required to tilt the axle under load is somewhat less.

Accordingly, a solid axle 270 is provided, which is rotatably mounted about a pin 272 in a fashion similar to that prescribed for the FIG. 5 configuration. The key to the FIG. 6 configuration is that instead of the mounting pin 272 being centrally disposed on the frame F of the scraper, it is offset to one side such that the pivot point is closer to one end of the axle than the other. By mounting the motor to the axle at a position on the other side of the centerline of the axle from the pivot point, leverage is created which permits the rotation of the axle 270 about the pin 272, in either direction, and because of the moment arm created, the amount of force required to effect movement is reduced.

Having thus described a preferred embodiment of the present invention, together with certain variations on the inventive theme, what is claimed is:

1. In a vehicle for use in cutting a swath through earthen terrain, of the type having a frame, a blade supported in fixed level relationship to said frame, for cutting a swath which is level in a plane transverse to the direction of travel of the vehicle, a bowl mounted on said frame, said bowl being contiguous to said blade, and being disposed for the collection of dirt cut from the earth to form the swath, means for maintaining the level attitude of said blade over uneven terrain, comprising, in combination:

at least two axle assemblies mounted to the frame of the vehicle, said axle assemblies being disposed opposite one another in a plane transverse to the direction of movement of the vehicle, each said axle assembly including a cylindrical hub, said hub having a longitudinal centerline transverse to the direction of travel of the vehicle, and having a spindle projecting outwardly therefrom, said spindle being parallel to, and offset relative to the longitudinal centerline of said hub, a wheel, said wheel being mounted for rotation on said spindle, power means for independently rotating each said hub relative to the frame of the vehicle to thereby adjust the height of the said wheel mounted thereon relative to the frame of the vehicle so as to maintain said blade in a level attitude.

2. The vehicle as set forth in claim 1, wherein said spindle projects outwardly and beyond the perimeter of said frame for receipt of a wheel thereon.

3. The vehicle as set forth in claim 1, including stop means, said stop means being affixed, respectively, to the frame of the vehicle and to said hub so as to limit the range of rotation of said hub.

4. The vehicle as set forth in claim 2, wherein stop means is provided, said stop means being affixed, respectively, to the frame of the vehicle and to said hub so as to limit the range of rotation of said hub.

5. The vehicle as set forth in claim 1, wherein said means for limiting movement of said hub includes stops disposed in spaced relation to the circumference of said hub, and a tang mounted on said frame in the plane of said stops, and disposed between said stops so that rotation of said hub will be inhibited by contact of said tang with said hub.

* * * * *